US006067828A

United States Patent [19]

Bucher et al.

[11] Patent Number: 6,067,828

[45] Date of Patent: May 30, 2000

[54] CRIMPING APPARATUS

[75] Inventors: Werner Bucher, Buchrain; Alois Lustenberger, Littau; Claudio Meissner, Cham, all of Switzerland

[73] Assignee: Komax Holding AG, Switzerland

[21] Appl. No.: 09/108,078

[22] Filed: Jun. 30, 1998

[30] Foreign Application Priority Data

Jun. 30, 1997 [CH] Switzerland ..... 1586/97

[51] Int. Cl.[7] ..... B21J 13/02

[52] U.S. Cl. ..... 72/21.4; 72/19.8; 72/413; 72/442; 72/409.06; 72/409.14; 29/751

[58] Field of Search ..... 29/751, 753; 72/413, 72/409.06, 409.14, 442, 19.8, 21.4

[56] References Cited

U.S. PATENT DOCUMENTS

| | | | |
|---|---|---|---|
| 4,982,830 | 1/1991 | Strong et al. . | |
| 5,275,032 | 1/1994 | Gloe et al. | 72/19 |
| 5,299,463 | 4/1994 | Gross | 72/753 |
| 5,323,634 | 6/1994 | Wolfe et al. | 72/446 |
| 5,337,589 | 8/1994 | Gloe et al. | 72/11 |
| 5,483,739 | 1/1996 | Smith et al. | 29/753 |
| 5,491,887 | 2/1996 | Quinn | 29/753 |
| 5,799,391 | 9/1998 | Tillotson | 29/753 |
| 5,887,469 | 3/1999 | Maeda et al. | 72/20.1 |
| 5,909,913 | 6/1999 | Fitz, Jr. et al. | 29/753 |

FOREIGN PATENT DOCUMENTS

| | | |
|---|---|---|
| 0 427 668 | 10/1990 | European Pat. Off. . |
| 0 622 873 | 3/1994 | European Pat. Off. . |
| 0 711 010 | 11/1995 | European Pat. Off. . |
| 0730 326 A2 | 2/1996 | European Pat. Off. . |

*Primary Examiner*—David Jones
*Attorney, Agent, or Firm*—Jeffer, Mangels, Butler & Marmaro LLP

[57] ABSTRACT

A crimping apparatus including a crimping station having a crimping press and at least one set of crimping tools. Each crimping tool includes a wire ram, an insulation ram, an anvil unit and a separating unit. The wire ram and the insulation ram of each crimping tool are associated with a ram holder and each of the ram holders includes crimping height-adjustment means. Crimping pressure-measuring elements that are connected to a control unit are included between the crimping press and the ram holders. During a crimping process a crimping force as determined by the crimping pressure-measuring elements is compared with a preset nominal value range. When the determined crimping force is outside of the range, a corresponding correction signal is produced in the control unit, thereby effecting a corresponding correction of the crimping height-adjustment means.

9 Claims, 16 Drawing Sheets

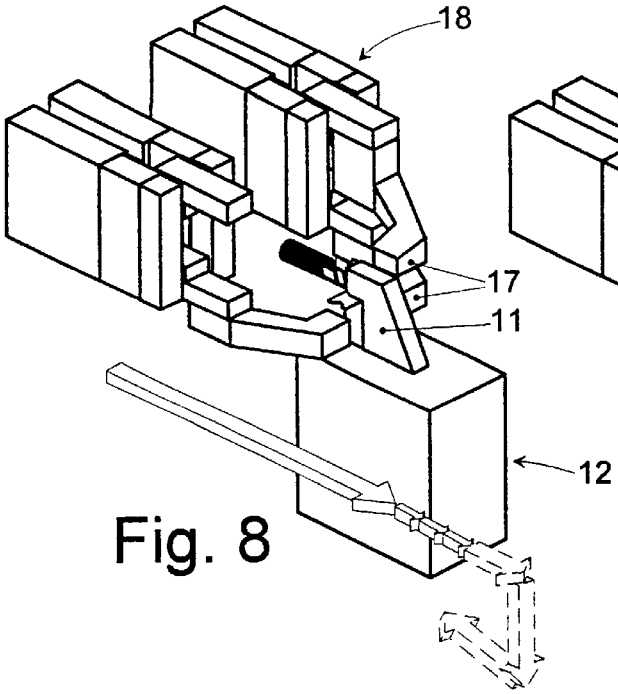
Fig. 8
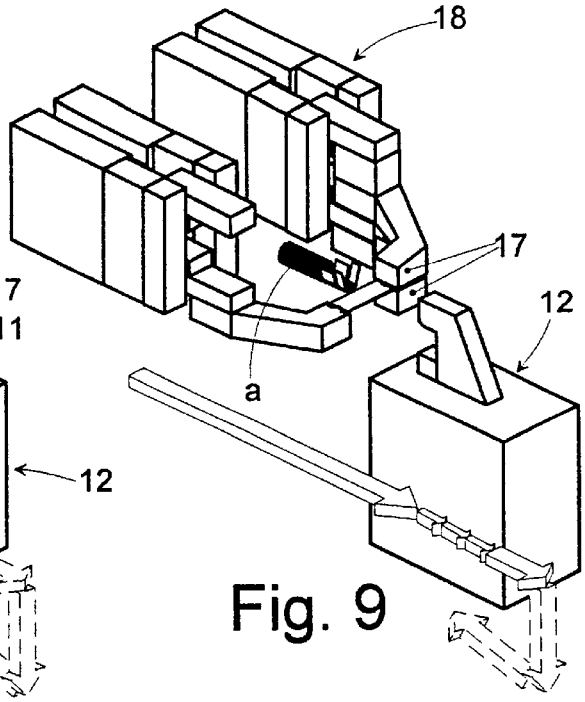
Fig. 9
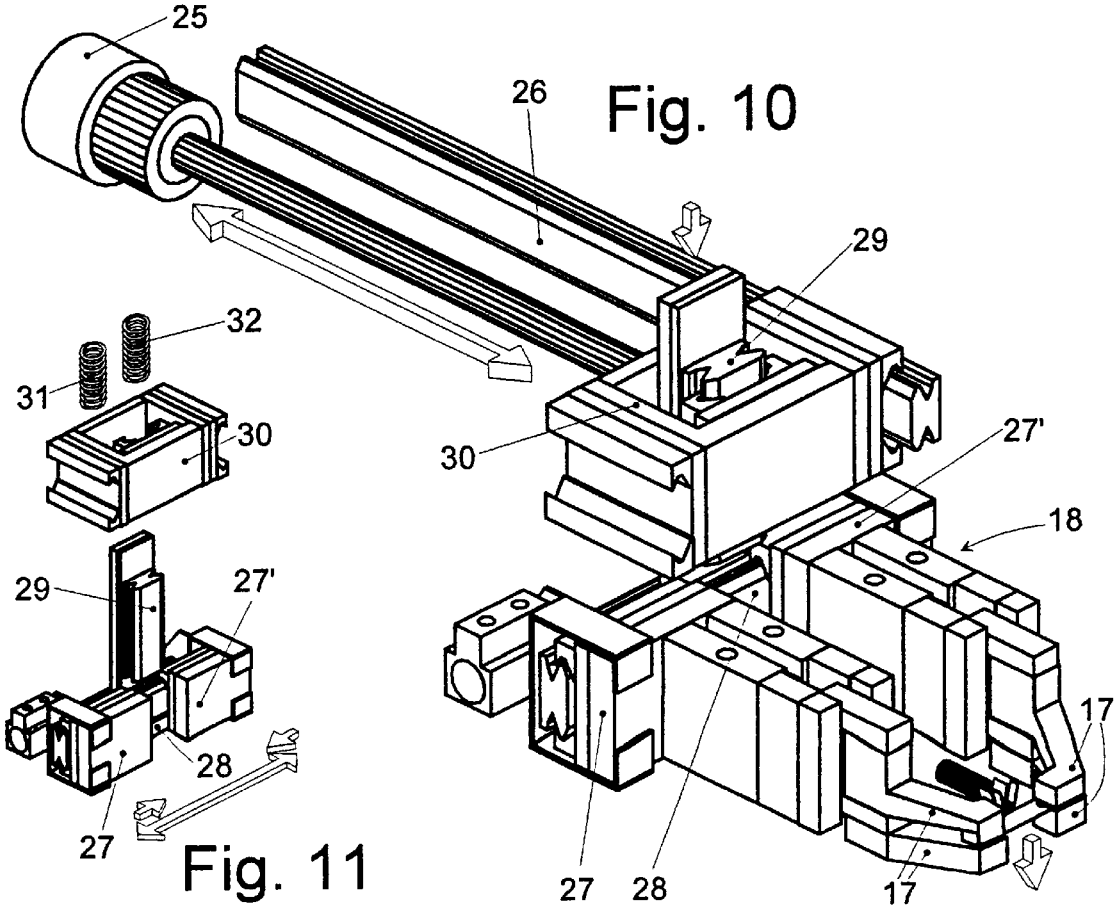
Fig. 10
Fig. 11

CRIMPING APPARATUS

BACKGROUND OF THE INVENTION

1. Field of the Invention

The invention relates to a crimping apparatus with a crimping station provided with a crimping press and at least one set of crimping tools, each being provided with a wire ram and an insulation ram, and each with an anvil unit and separating unit associated with the two latter.

2. Description of the Prior Art

In the processing (e.g. crimping, soldering, etc.) of contacts in a crimping apparatus, it is known that changing from one contact type to another contact type is relatively complicated and time-consuming, that is to say frequent alternation between different contact types is virtually impossible.

SUMMARY OF THE INVENTION

The object of the present invention is in particular to provide a crimping apparatus which does not have this above-mentioned disadvantage, that is to say which enables any desired alternation in the supply of different contact types to a contact processing station.

In accordance with one aspect of the present invention, there is provided a crimping apparatus including a crimping station having a crimping press and at least one set of crimping tools. Each crimping tool includes a wire ram, an insulation ram, an anvil unit and a separating unit. The wire ram and the insulation ram of each crimping tool are associated with a ram holder and each of the ram holders includes crimping height-adjustment means. Crimping pressure-measuring elements that are connected to a control unit are included between the crimping press and the ram holders. During a crimping process a crimping force as determined by the crimping pressure-measuring elements is compared with a preset nominal value range. When the determined crimping force is outside of the range, a corresponding correction signal is produced in the control unit, thereby effecting a corresponding correction of the crimping height-adjustment means.

In a preferred embodiment, the crimping tools, including the anvil units associated therewith, are arranged on a laterally displaceable cross slide having drive means associated therewith in order to selectively bring the crimping tool corresponding to the contact to be processed into a crimping operating position by lateral displacement of the cross slide. The two rams of each crimping insert are arranged individually on a ram holder that can be guided displaceably in a longitudinal direction on the cross slide. Each ram holder is also provided with a first latching part for releasable latching to the drive elements of the crimping press upon its displacement into the crimping operating position.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DESCRIPTION OF THE DRAWINGS

The invention may be more readily understood by referring to the accompanying drawing in which:

FIGS. 8 and 9 show the transfer of a contact band portion from the first contact transfer unit to the second contact transfer unit;

FIG. 10 is a perspective view showing the second contact transfer unit of the apparatus of FIG. 1;

FIG. 11 is a detailed exploded view of the second contact transfer unit of FIG. 10;

DESCRIPTION OF THE PREFERRED EMBODIMENTS

Parts which are analogous to one another are provided with the same reference symbols below, so that repeated description of parts which are analogous to one another is unnecessary.

In the exemplary embodiments described below, crimping stations are employed as the contact processing stations, although other kinds of processing stations, such as, for example, contact soldering stations, are of course also conceivable as the contact processing stations.

Figure 1:
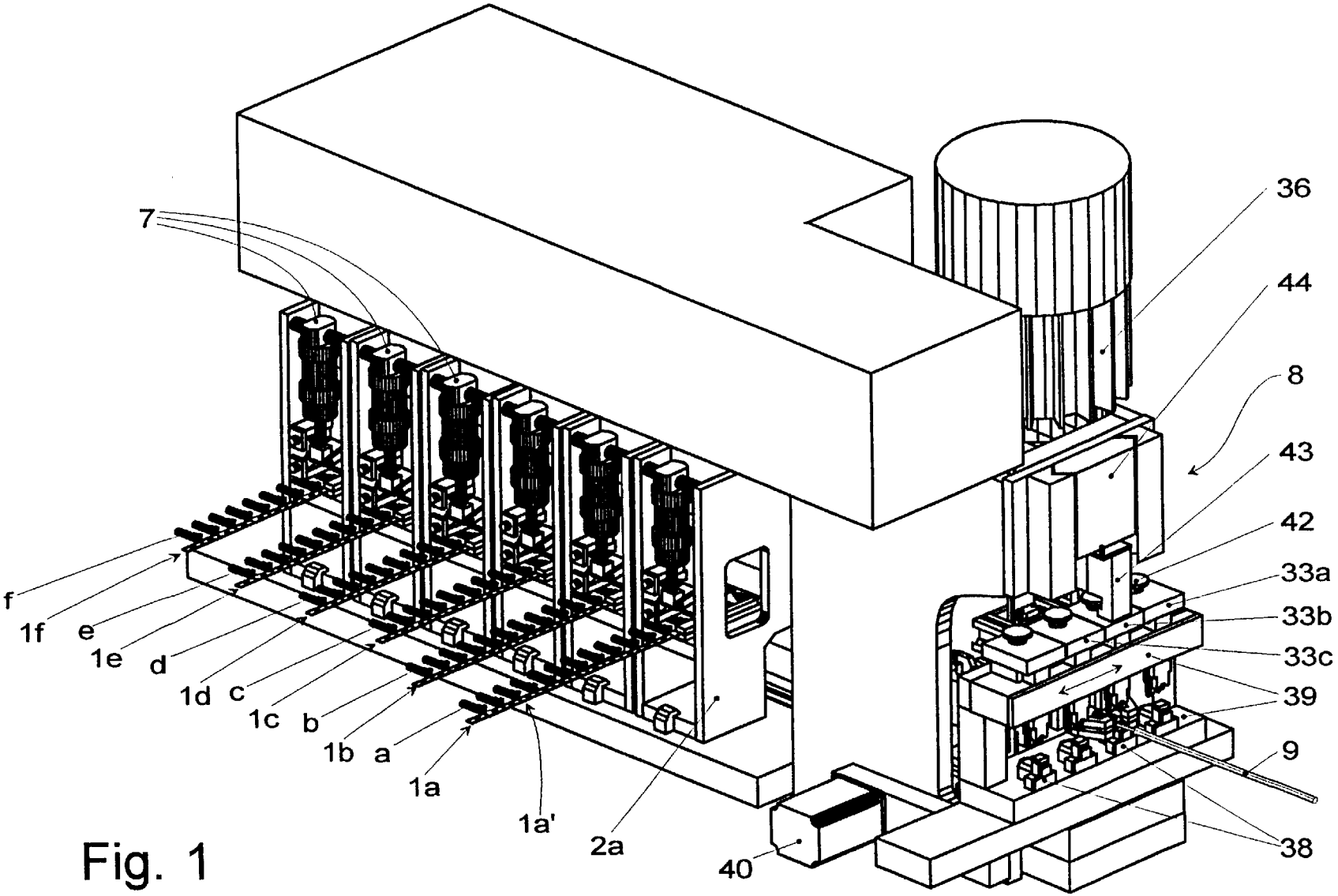
FIG. 1 is a perspective view of a first embodiment of an apparatus according to the present invention.
Figure 2:
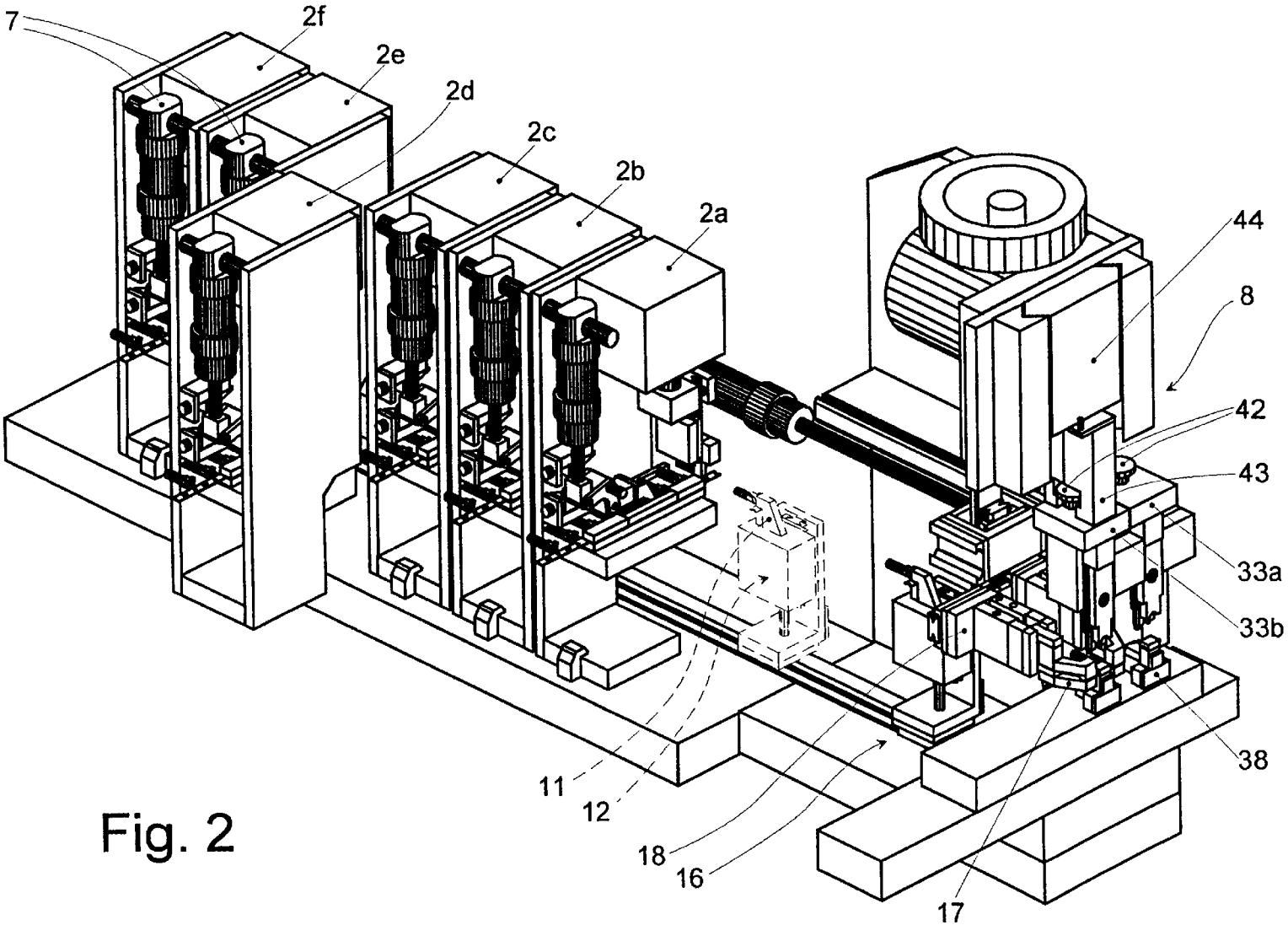
FIG. 2 is a view analogous to FIG. 1 but in which various wall parts of FIG. 1 have been omitted for greater clarity.
Figure 3:
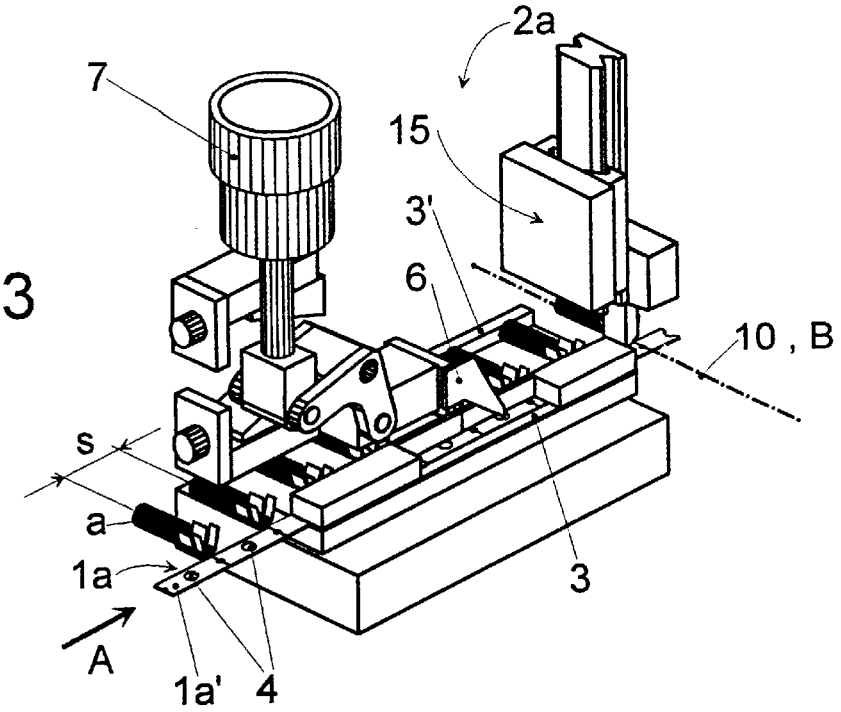
FIG. 3 is on enlarged perspective view showing the advancing and separating part of one of the contact supply stations shown in FIGS. 1 and 2.
Figure 4A:
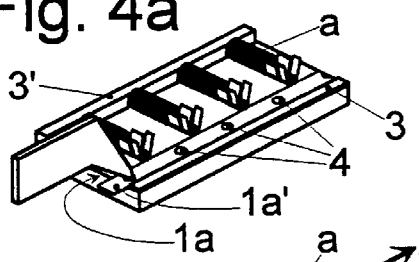
FIGS. 4*a* and 4*e* are perspective view showing the individual steps for advancing, transferring and separating an individual contact band portion.
Figure 4B:
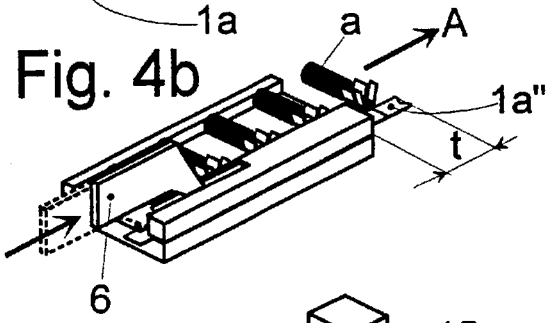
Figure 4C:
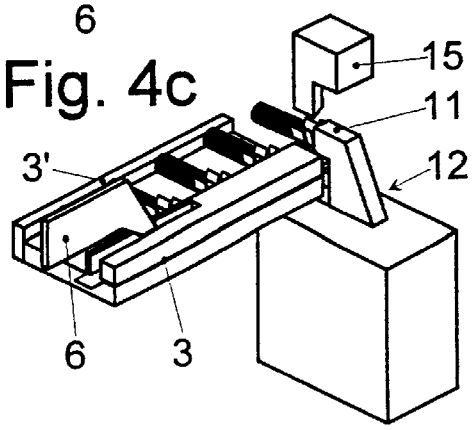
Figure 4D:
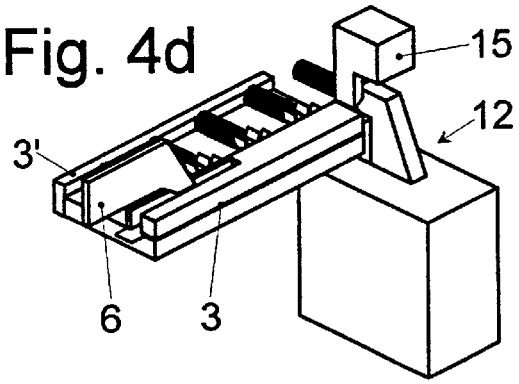
Figure 4E:
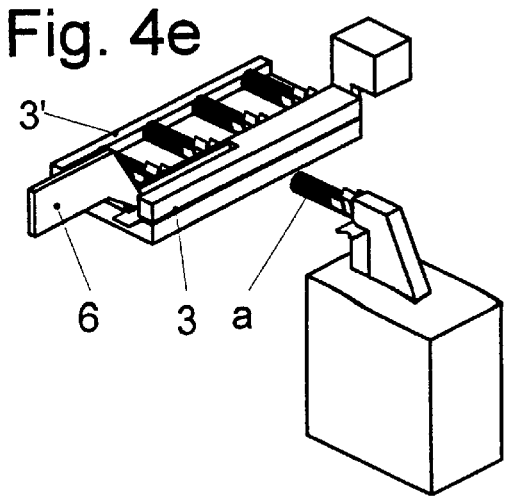

Referring to FIGS. 1 and 2, the apparatus illustrated therein has a plurality of contact supply stations 2*a* to 2*f* arranged side by side and each associated with one of the contact bands 1*a* to 1*f* which are to be supplied and differ from one another, and intended for selectively advancing a given contact a,b,c,d,e or f into a contact grasping position (see FIGS. 3, 4*b* and 4*c*).

To increase the flexibility of the apparatus, that is to say for the simple and rapid adaptation of the same to the wide variety of contact band types and also to a desired number of contact supply stations 2*a* to 2*f*, they are designed as individually mountable and/or exchangeable units (see 2*d* in FIG. 2).

Each of the contact supply stations 2*a* to 2*f* in this apparatus is provided, as can be seen in particular in FIGS. 3 and 4*a* to 4*e*, with a band guide 3,3' for lateral guidance of a respective contact band 1*a*, 1*b*, 1*c*, 1*d*, 1*e* and 1*f* to be transported forward in its longitudinal direction A, and also with advancing means 6 engaging in openings 4 of the respective contact carrier strip 1*a*', 1*b*', 1*c*', 1*d*', 1*e*' and 1*f*', and intended for the stepwise advance of a selected contact band 1*a* by a distance t (FIG. 4) corresponding to the respective lateral contact spacing s (FIG. 3).

Figures 5, 6, 7:
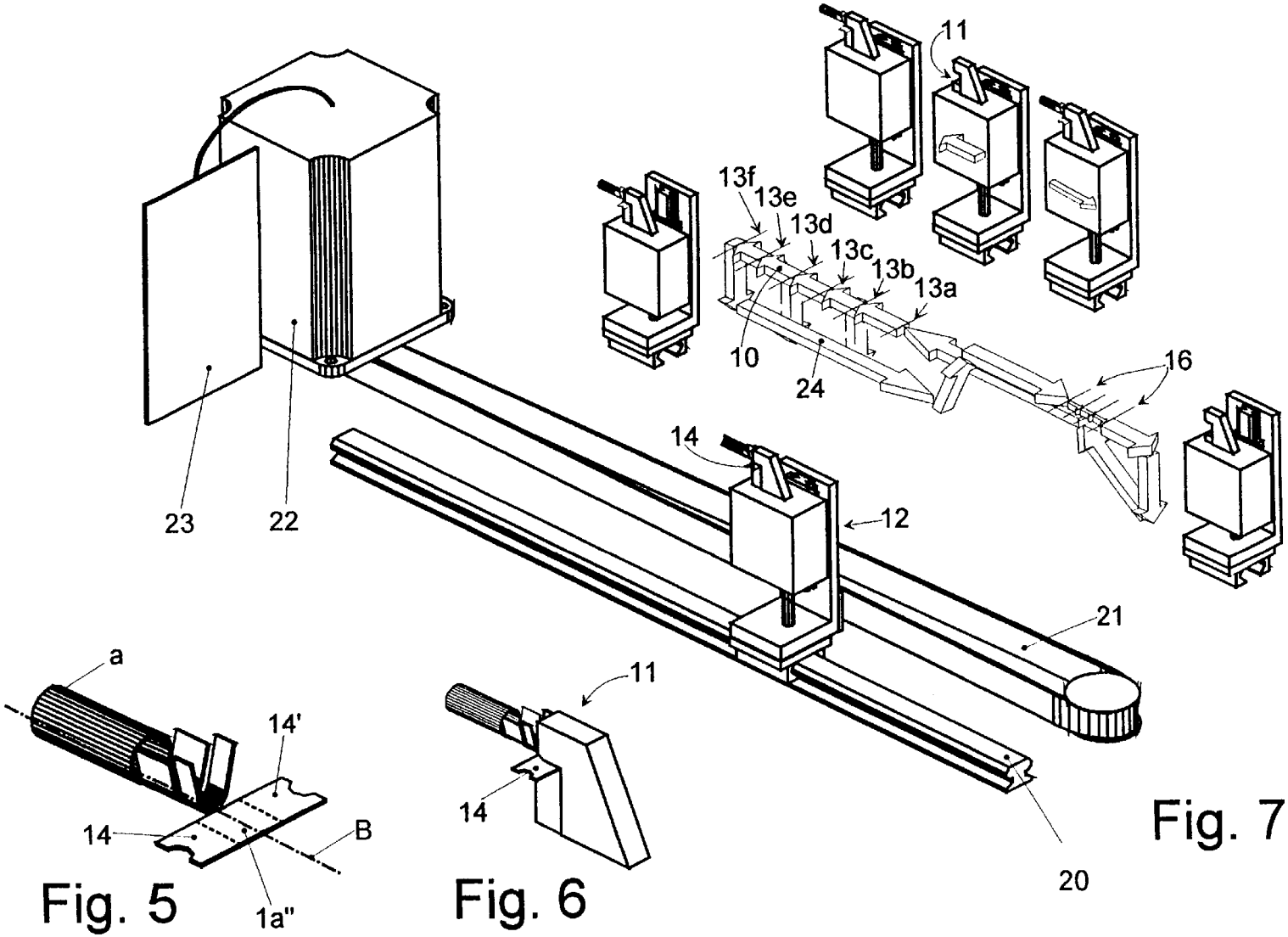
FIG. 5 is an enlarged perspective view showing an individual contact band portion separated from the contact band.
FIG. 6 is perspective view showing the contact band portion of FIG. 5, in the position in which it is grasped by the grasping part of the first contact transfer unit.
FIG. 7 is a perspective view showing the first contact transfer unit of the apparatus of FIG. 1.

The advancing means 6 in this apparatus are actuated in a known manner with the aid of pneumatic cylinders 7. The contact a to be fastened to a conductor 9 in the crimping station 8 is moved in this apparatus, by means of the contact carrier strip 1*a*' interconnecting the individual contacts a of a contact band 1*a*, into a contact grasping position 13*a* (FIG. 4*c*) situated in the displacement path 10 of a contact grasping part 11 of a first contact transfer unit 12. In said contact grasping position, the contact a to be supplied to the crimping station 8 is grasped, by way of its contact carrier strip portion 1*a*" (see FIGS. 4*b* and 5) associated with it, in its central region in the direction of the longitudinal axis B of the associated contact a by means of the contact grasping part 11, with two lateral outer portions 14 and 14' (see FIGS. 5 and 6) of the contact carrier strip portion 1*a*" being left free, and thereafter is separated from the remaining, rear part of the contact carrier strip 1*a*' by means of a separating unit 15. In order to enable such a central grasping of the contact carrier strip portion by the contact grasping part 11 irrespective of the length of the respective contact carrier strip portion, which varies with different contact bands 1*a* to 1*f*, the individual contact band portions are each moved forward into the assigned contact grasping position until the longitudinal axis B (FIG. 5) thereof is situated precisely centrally in the displacement path 10, that is to say in the contact grasping position of the contact grasping part 11. The contact grasping positions of all the contact supply stations 2*a* to 2*f* are thus situated on a common line 10 irrespective of the size of the contacts a to f to be supplied. Subsequently, the contact a held in such a manner by way of the associated contact carrier strip portion 1*a*" is moved by means of the first contact transfer unit 12, for supply to the crimping station 8, into a transfer position 16 shown on the right in FIGS. 2 and 7, where the contact a is grasped by means of a contact grasping part 17 of a second contact transfer unit 18 by way of the two lateral outer portions 14 and 14' of the associated contact carrier strip portion 1*a*' which are left free by the contact grasping part 11 of the first contact transfer unit 12, is taken up by the second contact transfer unit 18, when released by the contact grasping part 17, for the purpose of fastening it to the conductor 9, and is then supplied to the crimping station 8.

After the transfer of the contact carrier strip portion 1*a*" to the contact grasping part 17 of the second contact transfer unit 18 in the transfer position 16 and the release of the contact carrier strip portion 1*a*", the contact grasping part 11, for unobstructed return travel of the first contact transfer unit 12 into one of the possible contact grasping positions 13*a*, 13*b*, 13*c*, 13*d* . . . located in front of the contact supply stations 2*a* to 2*f*, is lowered beneath the contact grasping part 17 of the second contact transfer unit and also beneath the second contact transfer unit. After passing the contact grasping part 17 and the second contact transfer unit 18, the contact carrier strip portion 1*a* is lifted again up to the height of the contact grasping positions 13*a*, 13*b*, 13*c*, 13*d* etc.

To displace the first contact transfer unit 12 along its displacement path 20, there is provided an endless conveyor belt 21, designed as a toothed belt, which extends along the displacement path, is connected at one point to the first contact transfer unit 12, runs at its one return end round a correspondingly toothed return roller, and is in positive engagement with the return roller. This return roller is drivingly connected to a stepping motor 22 which, for its control and that of the displacement travel of the first contact transfer unit 12, is connected to a control unit 23 by way of which the respective end positions 16; 13i a, 13*b*, 13*c*, 13*d* . . . of the displacement path 20 can be set.

In order to avoid a situation where the contact carrier strip portion 1*a*", upon its conveyance from, for example, its contact grasping position 13*d* into the transfer position 16, touches in one of the other possible contact grasping positions 13*c*, 13*b* and 13*a*, the contact grasping part 11 of the first contact transfer unit 12 is moved past in a sufficiently lowered manner on this stretch 24, in order to be lifted thereafter to the level of the transfer position 16 again before reaching the latter.

The second contact transfer unit 18 is displaceable along a guide 26 between two end stops with the aid of a hydraulic or pneumatic positioning cylinder 25. To adapt the contact grasping part 17 of the second contact transfer unit 18 to contact carrier strip portions 1*a*" of different sizes, the two gripper parts are adjustably guided on a crossbeam 28 by way of two slide parts 27 and 27' laterally displaceable relative to one another in the horizontal direction. The crossbeam 28 is for its part displaceably guided in a displacement slide rest 30 by way of a carrying and guiding part 29 extending in the vertical direction and is resiliently supported therein by way of the compression springs 31 and 32.

The crimping station 8 of the apparatus illustrated in FIGS. 1 and 2 may be equipped, for example, with a perfectly conventional crimping tool 33, as can be seen in FIGS. 12 to 15.

Figure 12:
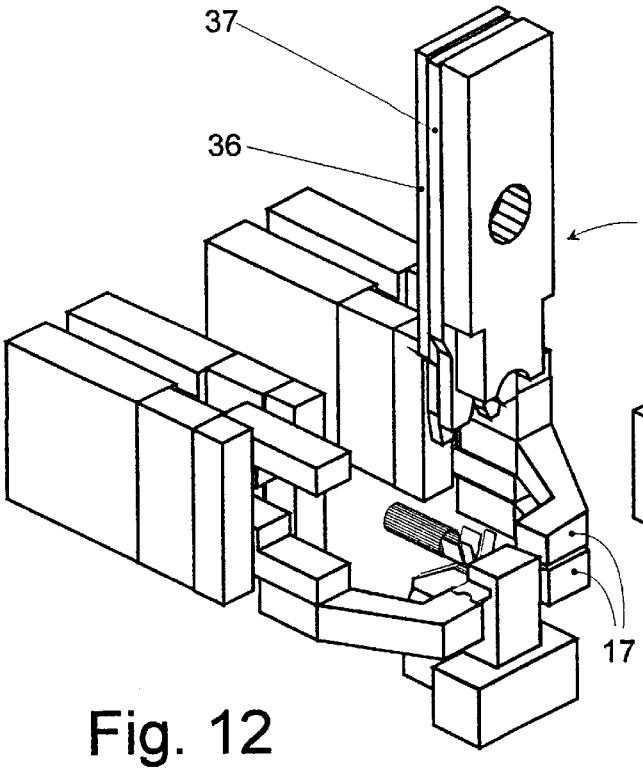
FIGS. 12 to 15 are perspective views showing, the supply and processing of a contact to be fastened to a conductor in the crimping station.
Figure 13:
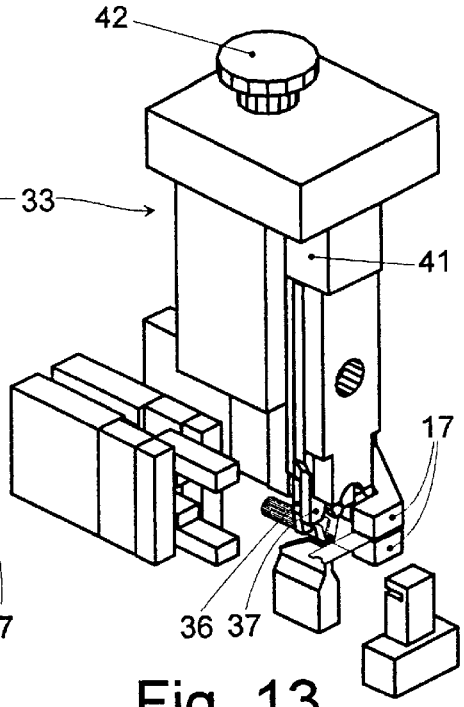
Figure 14:
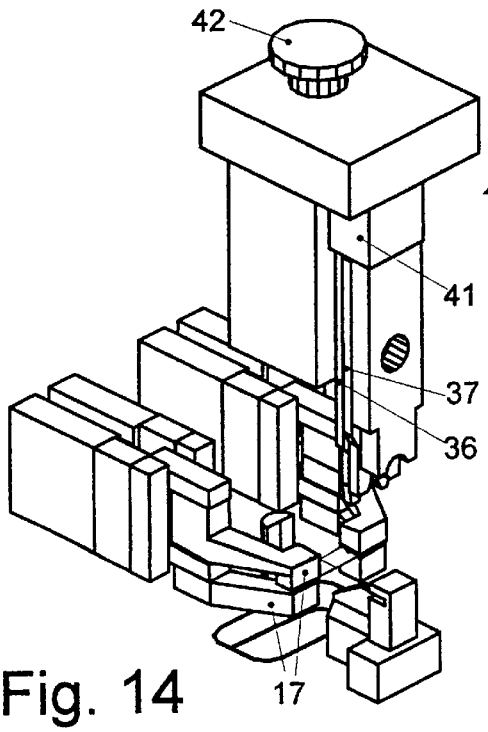
Figure 15:
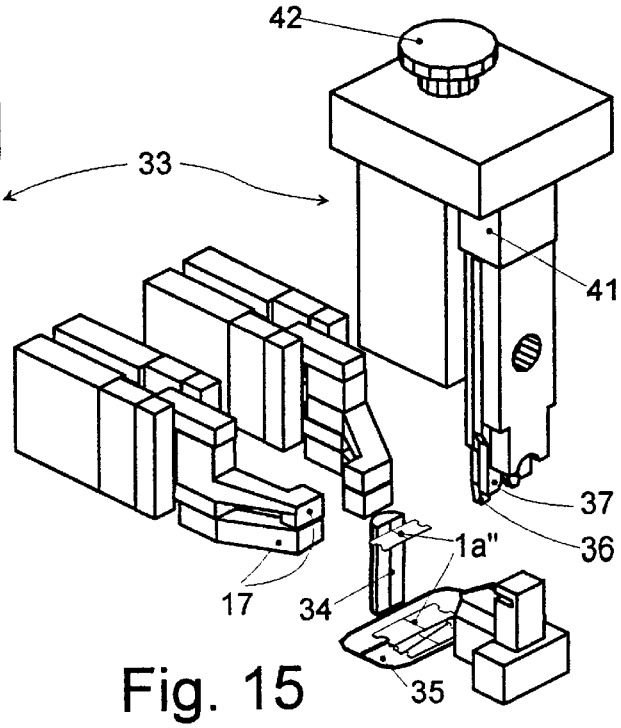

Upon lowering of the crimping tool 33 in accordance with FIG. 12, the contact grasping part 17 is at the same time likewise moved slightly downward against the spring pressure exerted by the compression springs 31 and 32, whereby, during the crimping operation, the contact carrier strip portion 1*a*" is separated from the contact a by means of the two cooperating separating elements 85,86.

After the crimping tool 33 has released the contact a fastened to the conductor 9, the contact grasping part 17 is moved back into the transfer position 16 again, during which the contact carrier strip portion 1*a*" which has been previously separated and is still located in the opened contact grasping part 17 is pushed out of the opened contact grasping part 17 by means of a stripping bolt 34 capable of being swung up and drops down into a collecting receptacle 35.

The drive of the crimping press is effected in customary fashion by means of a drive motor 36.

Since for the crimping of different contacts in most cases different crimping tools are also required, the crimping station 8 has, as can be seen in FIGS. 1 and 2, a plurality of crimping tools 33*a*, 33*b*, 33*c* . . . , designed as conventional quick change tools, which are arranged side by side, have different crimping inserts and are laterally displaceable with one another, said crimping tools each being provided with a wire ram 36 and an insulation ram 37, and each with an anvil unit 38 associated therewith.

In this case, the crimping tools 33*a*, 33*b*, 33*c* . . . , including the anvil units 38 associated therewith, are arranged, as can be seen in FIG. 1, on a laterally displaceable cross slide 39, and drive means 40 connected to the latter are provided in order selectively to bring a crimping tool 33*b* corresponding to the contact a to be processed into its crimping operating position by lateral displacement of the cross slide 39.

The ram holders 41 of the individual crimping tools 33*a*, 33*b*, 33*c* . . . are each provided on their upper side, as can be seen in particular in FIG. 1, with a latching part 42 for laterally releasable latching to the drive elements 43,44,36 of the crimping press 8 upon displacement thereof into the crimping operating position.

Figure 16:
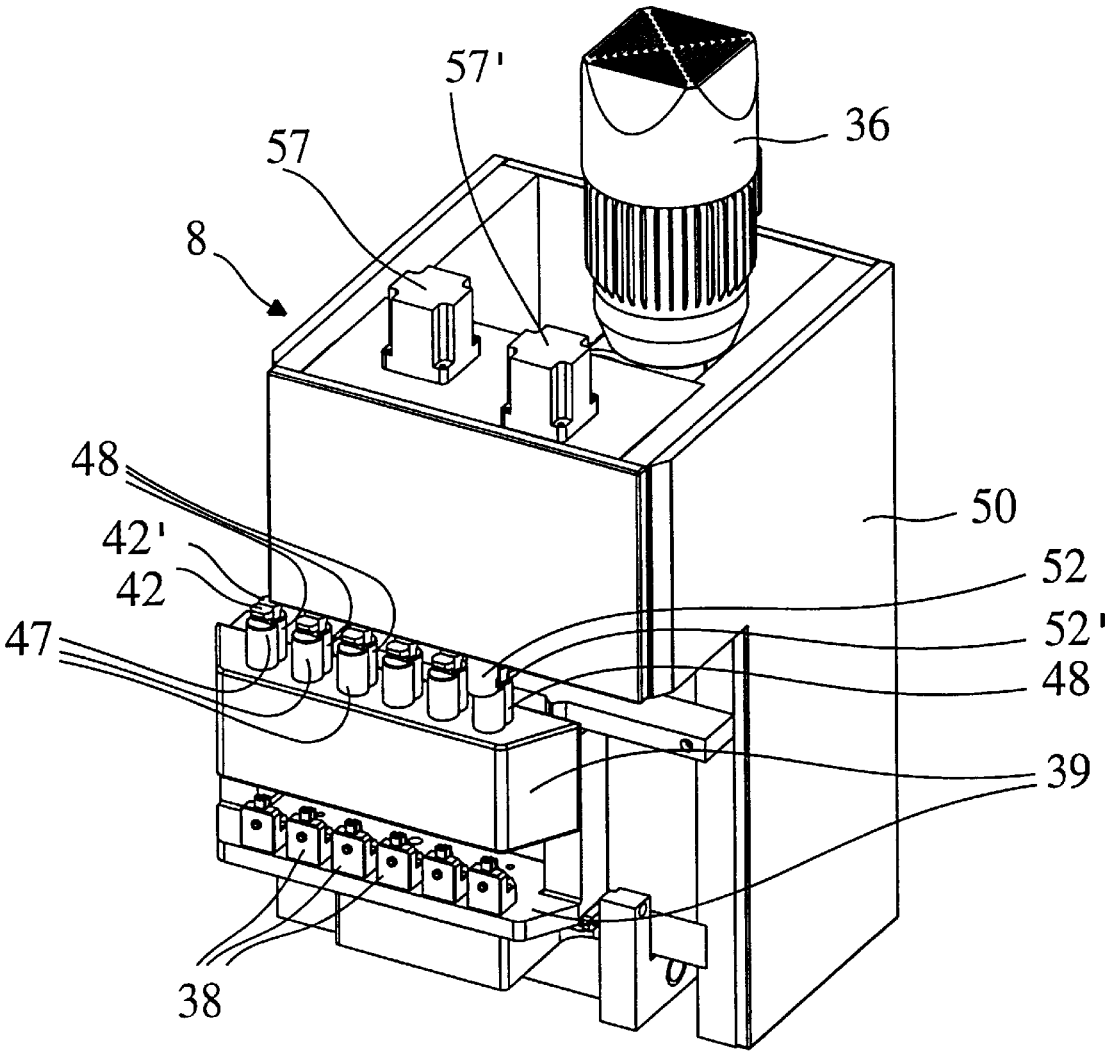
FIG. 16 is a perspective view of a crimping pressing unit of a second embodiment of an apparatus according to the present invention.

Illustrated in FIG. 16 is a further exemplary embodiment of a crimping station 8 according to the present invention which is provided with a respective electrically actuable crimping height-adjustment means for the wire ram 36 and for the insulation ram 37, so that both rams can be adjusted completely independently of one another in respect of their crimping height.

Figure 26:
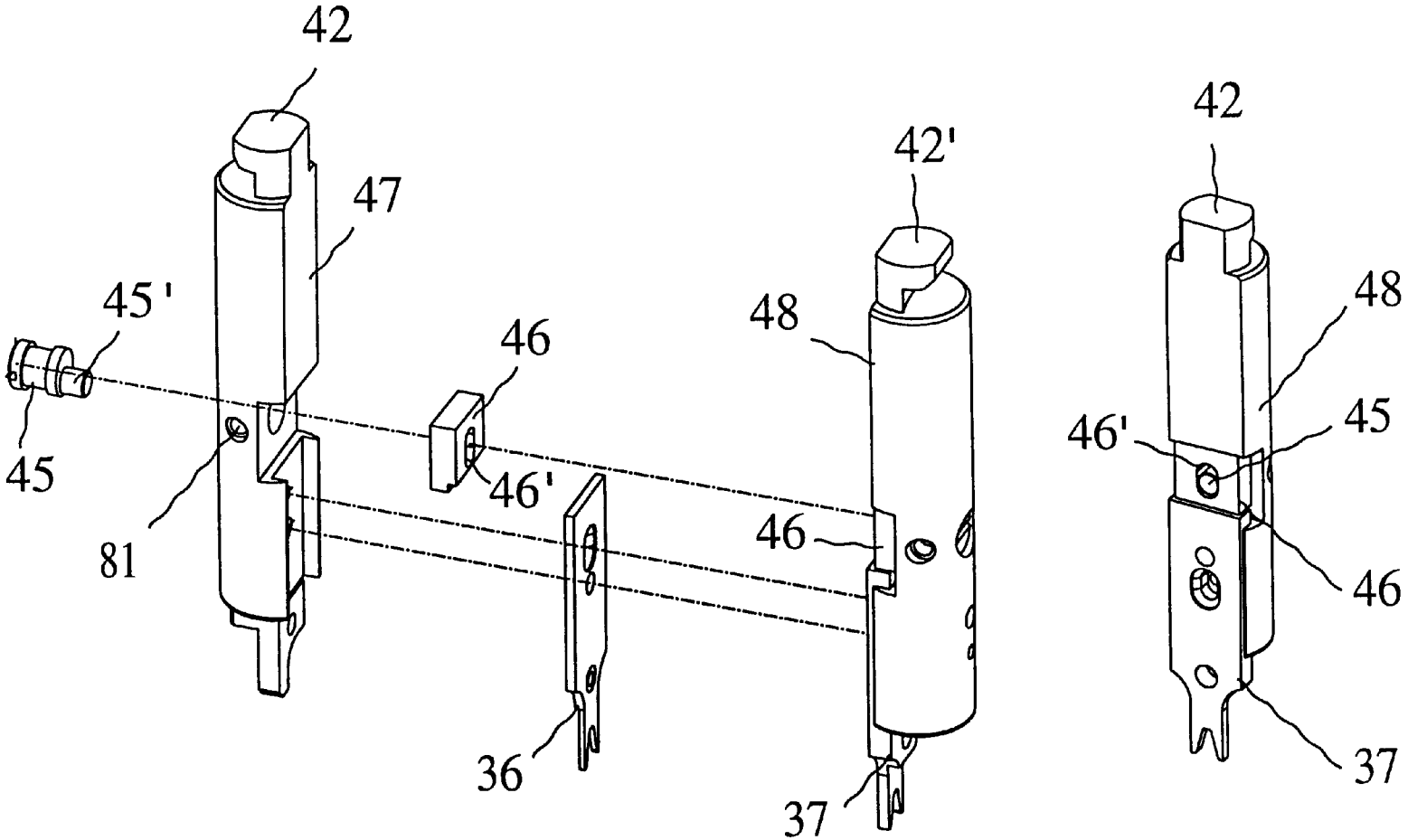
FIG. 26 is an exploded view showing another embodiment of a crimping height-adjustment means.

In this case, the wire ram 36 and the insulation ram 37 of each individual crimping insert are arranged individually on a respective ram holder 47 and 48 analogously to the embodiment illustrated in FIG. 26 but without the crimping height fine-adjustment elements 45,46 drawing therein.

Figure 17:
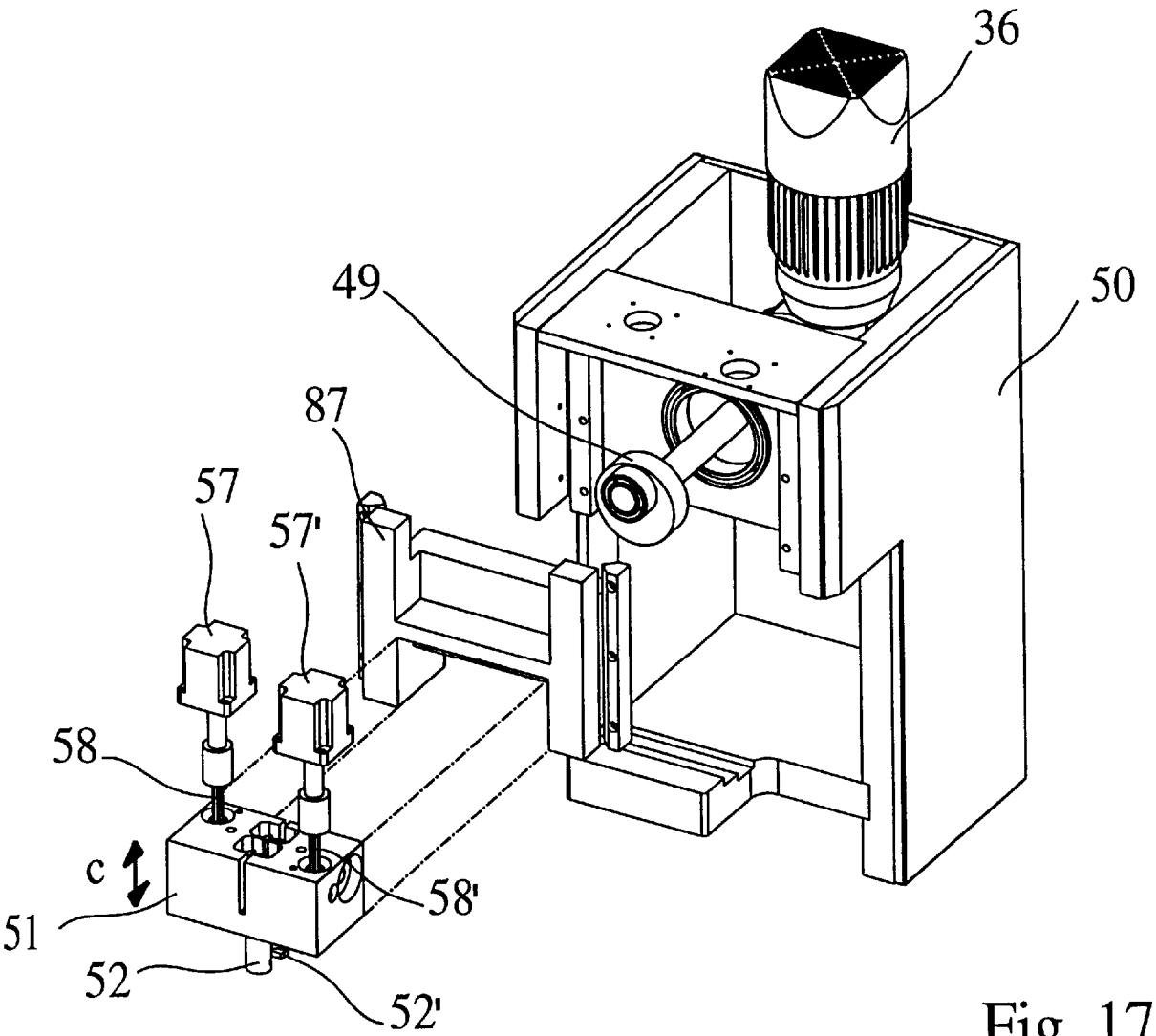
FIG. 17 is a exploded view of the press drive of the crimping pressing unit of FIG. 1.

Referring to FIG. 17, this crimping station 8 illustrated in FIG. 16 has an eccentric drive 49 which is connected to the drive motor 36 and, in order to bring about a stroke movement of a drive slide 51 guided displaceably in its vertical displacement direction C in the housing 50, acts on the drive slide by way of a rammer 87 connected to the latter.

To adjust the crimping height of the two ram holders 47 and 48 situated in the crimping operating position, there are provided further latching parts 52 and 52' which can be brought into releasable engagement with the latching parts 42 and 42' of the two ram holders by lateral displacement and are arranged in the drive slide 51 in such a way as to be adjustable in the displacement direction C of the latter.

Figure 18:
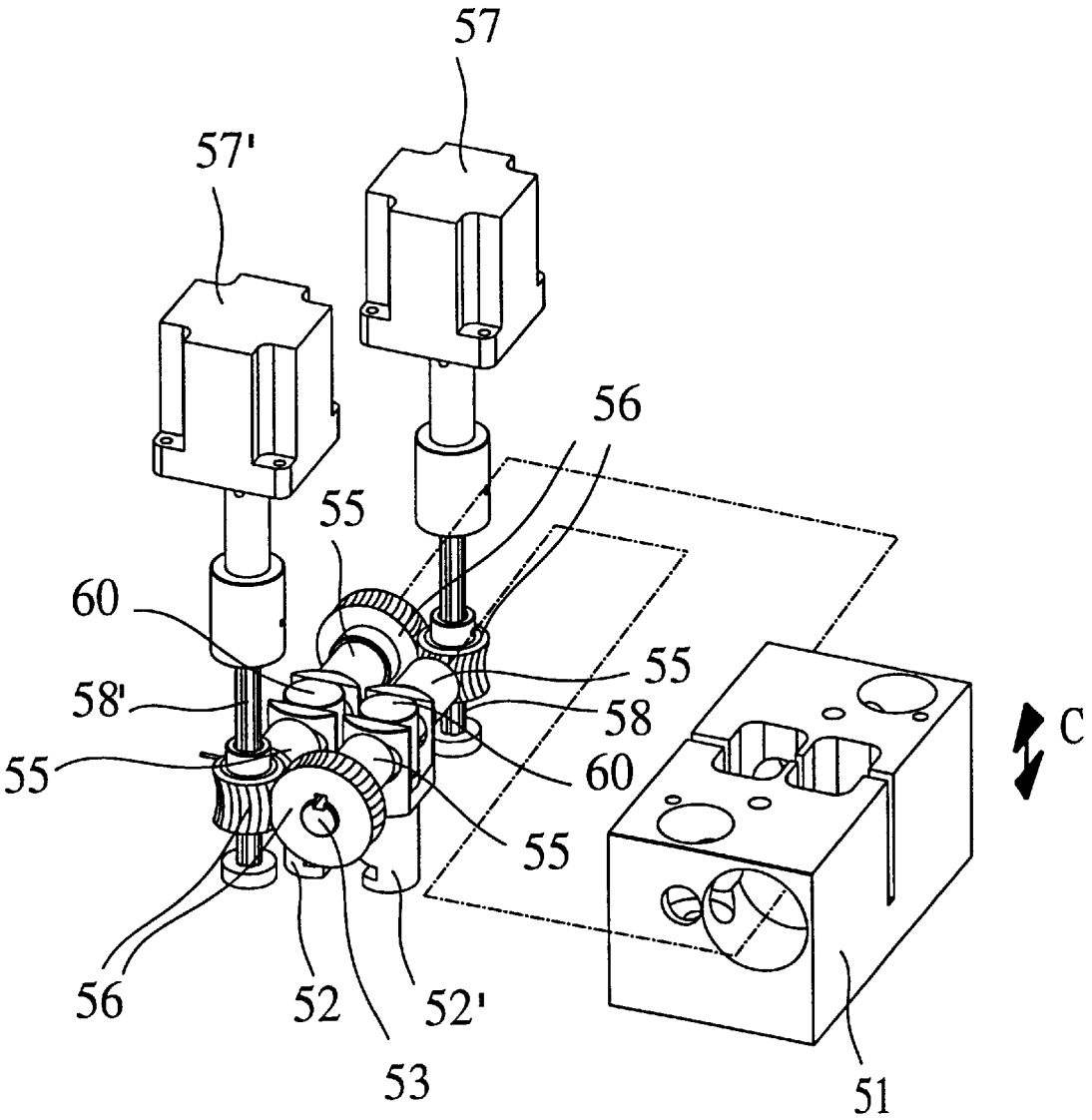
FIG. 18 is a perspective view showing the crimping height-adjustment means of the crimping pressing unit of FIGS. 16 and 17.
Figure 19:
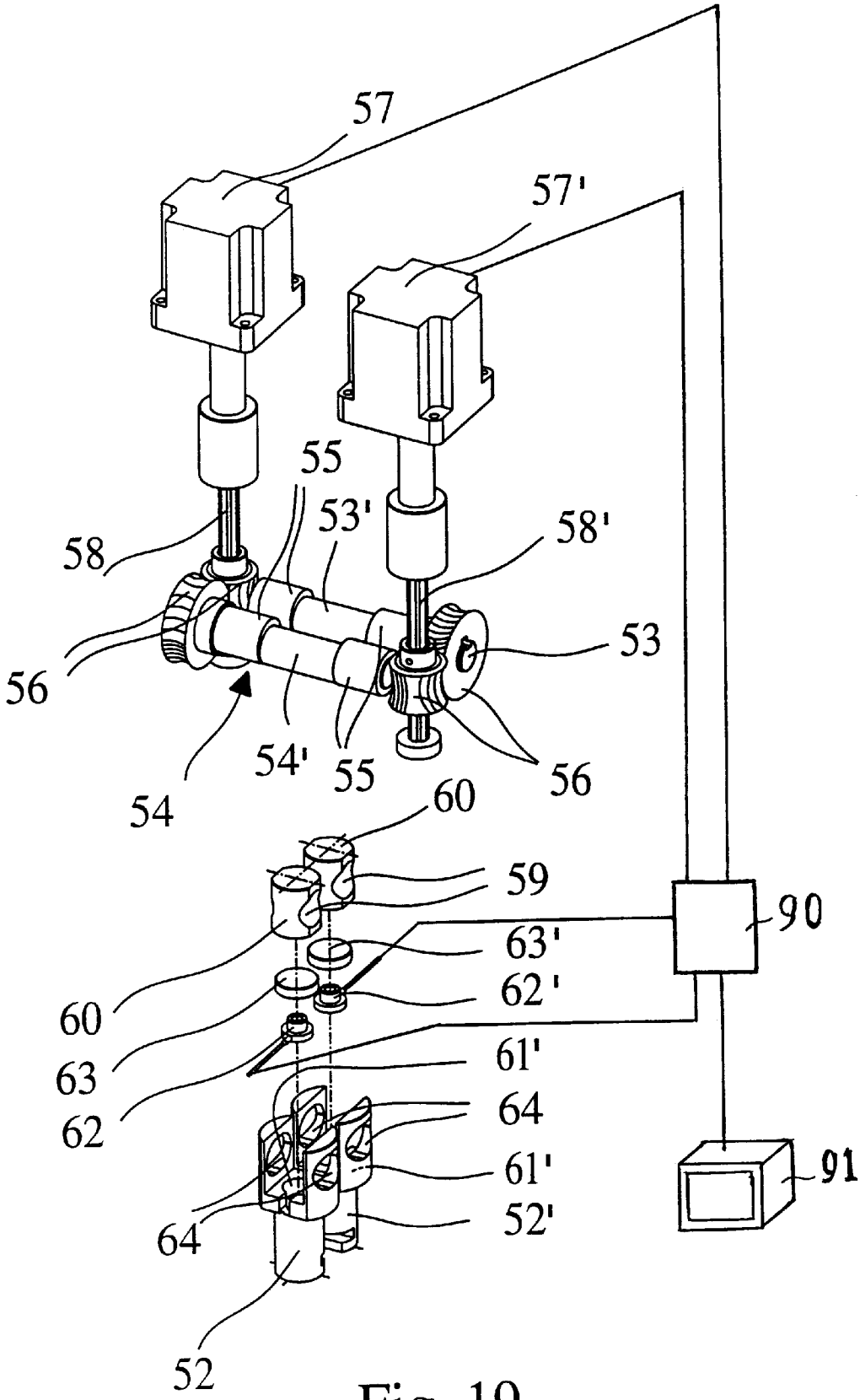
FIG. 19 is a exploded view of the crimping height-adjustment means of FIG. 18.

For individual adjustment of the crimping height, two eccentric shafts 53 and 54 are rotatably mounted by way of the sliding bearings 55 in the drive slide 51, as can be seen in FIGS. 18 and 19. The drive of the two eccentric shafts 53 and 54 is effected in each case by way of a worm gear 56 driven by way of a respective splined shaft 58 and 58' connected to a stepping motor 57, 57'. The two stepping motors 57 and 57' are fastened to the housing 50, as can be seen in FIG. 16.

The eccentric central parts 53' and 54' of the two eccentric shafts 53 and 54 each engage an opening 59 of a pressure piece 60.

The further latching parts 52 and 52', which are of peg-shaped design, are guided in such a way as to be displaceable in the vertical direction in cylindrical bores of the drive slide 51 and in their upper part have a respective recess 61 and 61' for receiving a respective pressure sensor 62 and 62' and also a respective pressure disc 63 and 63' which covers the recess and supports the associated pressure piece 60 and 60'. The pressure sensors 62 and 62' are connected to an evaluating circuit in which, during the crimping operation, the crimping force exerted on the two rams 36 and 37 is recorded and if a preset setpoint range is exceeded or undershot an error signal is emitted and/or the apparatus is turned off.

The through bores 64 and 64' provided in the upper parts of the further latching parts 52 and 52' for the unobstructed passage of the eccentric central parts 53' and 54', respectively, are dimensioned and designed in such a way that the respective eccentric central parts 53' and 54' extending therethrough do not come bear in these respective through bores 64 and 64' during the crimping operation, that is to say when a pressing force is exerted downwardly on the two further latching parts 52 and 52', respectively, and thus the entire crimping force is transmitted by way of the associated pressure sensors 62 and 62', respectively.

Figure 20:
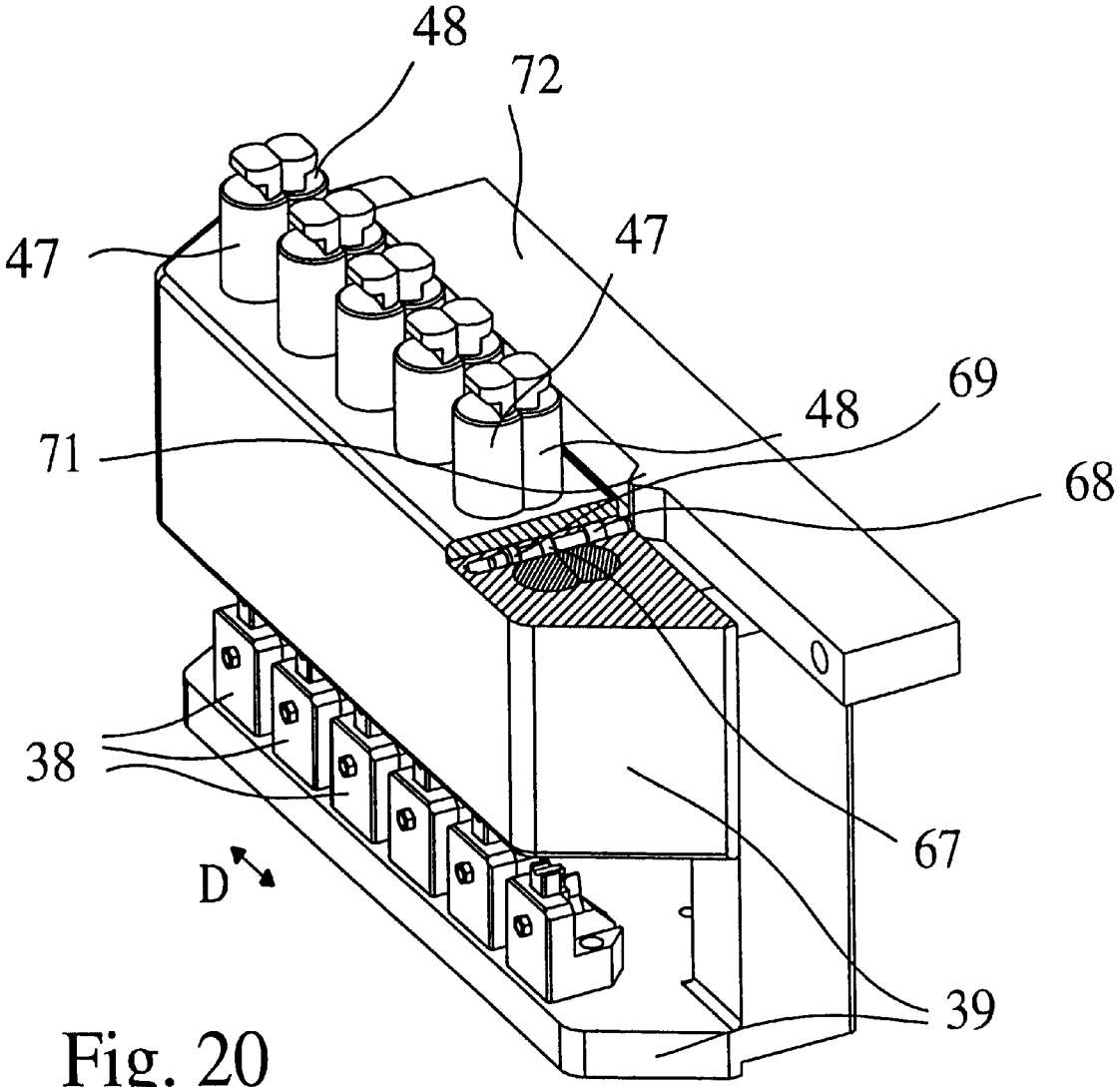
FIG. 20 is a perspective view showing the cooperation of the latching means, arranged in the cross slide, with an unlatching element fixedly arranged on the crimping press.
Figure 24:
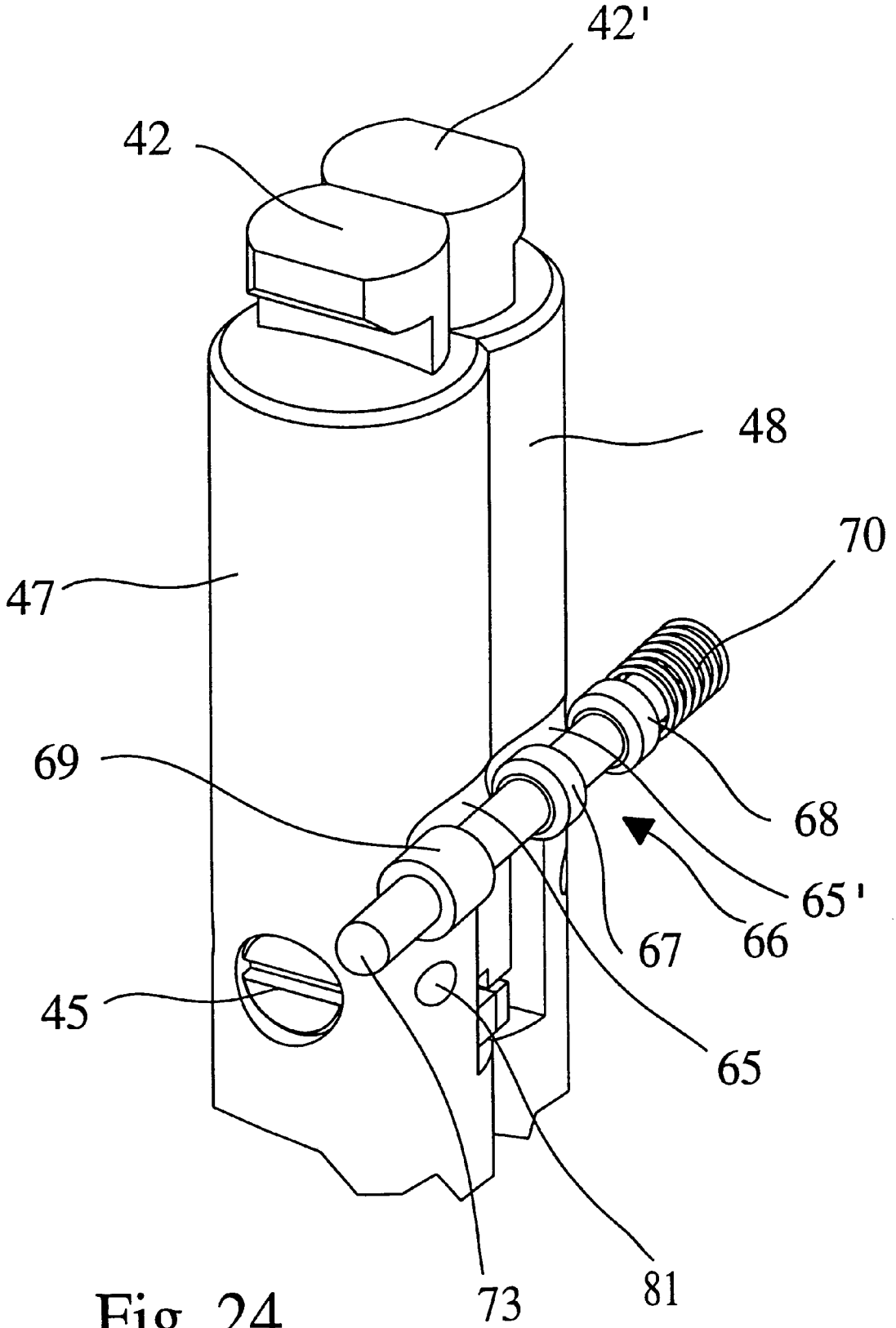
FIG. 24 is an enlarged perspective view showing the cooperation of latching means with two mutually associated ram holders.

Referring to FIGS. 20 and 24, there are provided, furthermore, latching means 65, 65' to 72 which cooperate with the ram holders 47 and 48 and are arranged and/or designed in such a way that the ram holders 47 and 48, upon their lateral displacement out of a crimping operating position by lateral displacement of the cross slide 39 in the direction of the arrow D, that is to say upon uncoupling from the drive elements 96, 49, 51, and 52 and 52', respectively, of the crimping press, are held in their upper starting position by means of these latching means, or, upon their lateral displacement into the crimping operating position, that is to say upon coupling to the drive elements 52, 52' of the crimping press, are released for their longitudinal displacement in the vertical direction.

For this purpose, each ram holder pair 47,48 is provided with a locking bolt 66 which is provided with two locking cams 67,68 and a guiding part 69 and is displaceable in its longitudinal direction against the spring pressure of a compression spring 70 into an unlocking position. Such a displacement is brought about in the crimping operating position of a ram holder pair 47,48 with the aid of a cam 71 which is provided on a cam strip 72 and in this position presses the end part 73, projecting rearwardly out of the cross slide 39, of the locking bolt 66 inwardly to such an extent that the two locking cams 67 and 68 come out of engagement with the associated locking recesses 65 and 65' respectively provided in the ram holders 47 and 48, and thereby release the ram holders 47 and 48 connected to the further latching means 52 and 52' of the drive slide 51 for their longitudinal displacement in the vertical direction.

Figure 21:
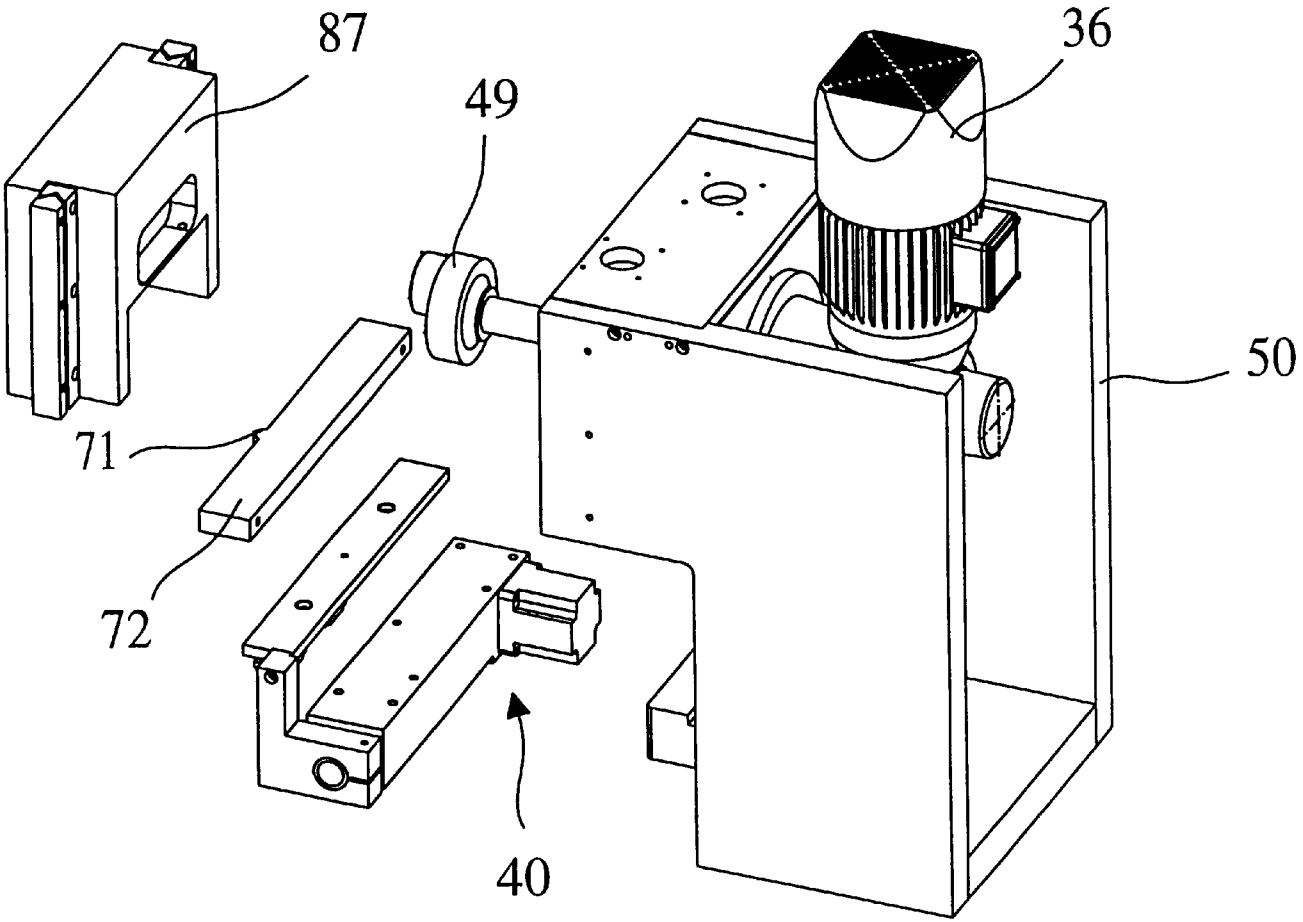
FIG. 21 is a exploded view showing various parts of the crimping pressing unit of in FIG. 16.
Figures 22, 23:
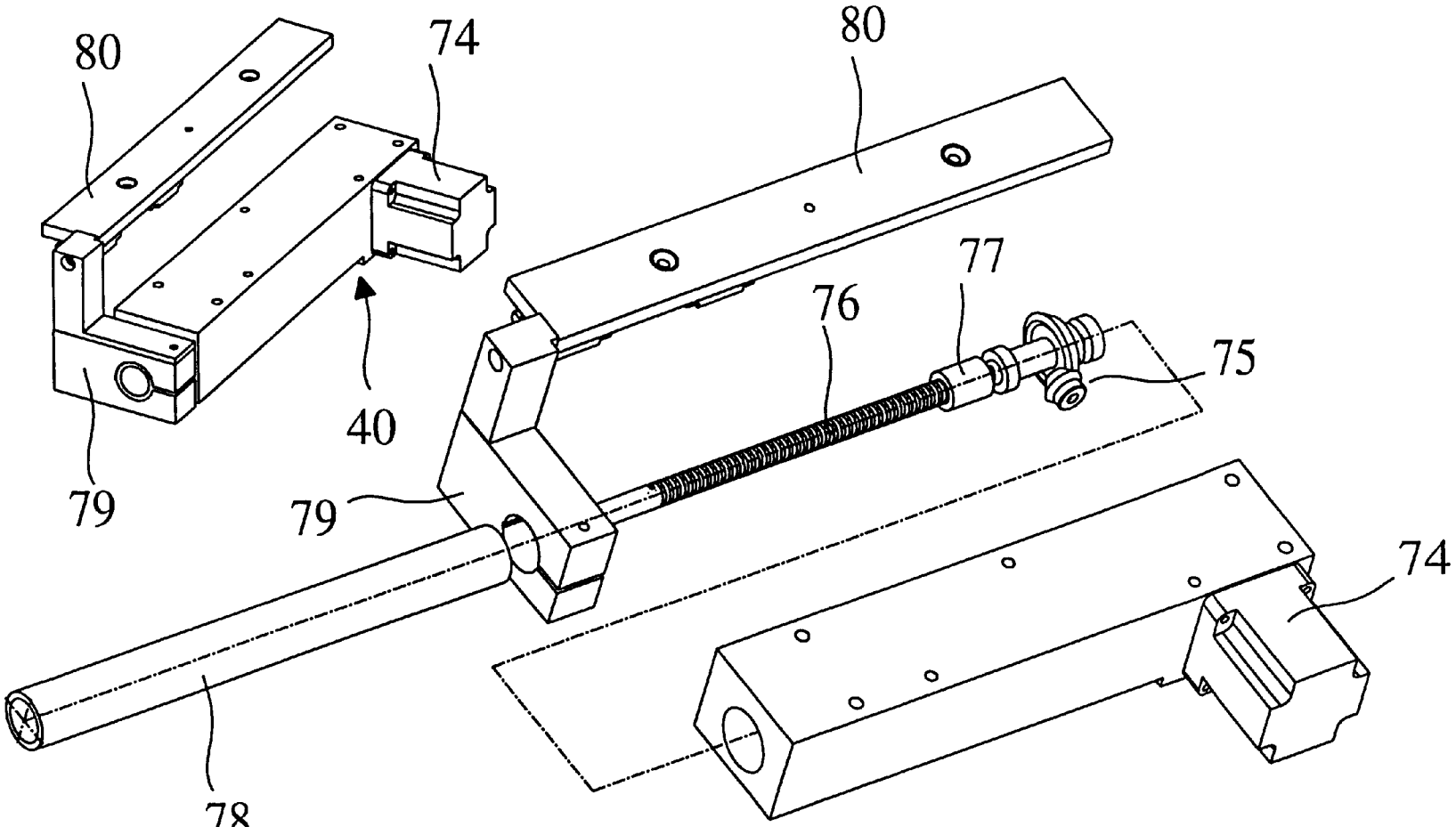
FIG. 22 an exploded view showing the cross slide drive of the crimping pressing unit of FIG. 16.
FIG. 23 shows the cross slide drive of FIG. 22, in the assembled state.

The drive means 40 of the cross slide 39, which have already been mentioned in connection with FIG. 1, are illustrated in detail in FIGS. 21 and 22.

As can be seen in FIGS. 21 and 22, a stepping motor 74, for example, acts here by way of a bevel gearing 75 on an adjusting spindle 76 which for its part acts by way of a spindle nut 77 and a tube sleeve 78 connected to the latter on an angle part 79, the latter for its part being connected to a fastening part 80 for fastening to the cross slide 39. The stepping motor 74 for its part is connected to control electronics which bring about precise control of the displacement of the various crimping tools into the crimping operating position.

If the crimping station 8 is not provided with an electrically actuable crimping height-adjustment means, the ram holders 47 and 48 serving to receive the wire ram 36 and also the insulation ram 37, respectively, may also each be provided, as can be seen in FIGS. 24 and 26, for the fine adjustment of their crimping height, with an eccentric part 45, the eccentric pin 45' of which extends into a longitudinal slot 46' extending in the vertical direction and provided in a wedge element 46, of wedge-shaped design in the horizontal direction.

The longitudinal slot 46' serves to bring about, upon rotation of the eccentric pin 45', only a displacement of the wedge element 46 in the horizontal direction, but no forced deflection of same in the vertical direction.

After the fine adjustment of a respective ram 36 and 37 by means of the eccentric part 45 has been effected, the latter is blocked by means of a clamping screw 81.

Figure 25:
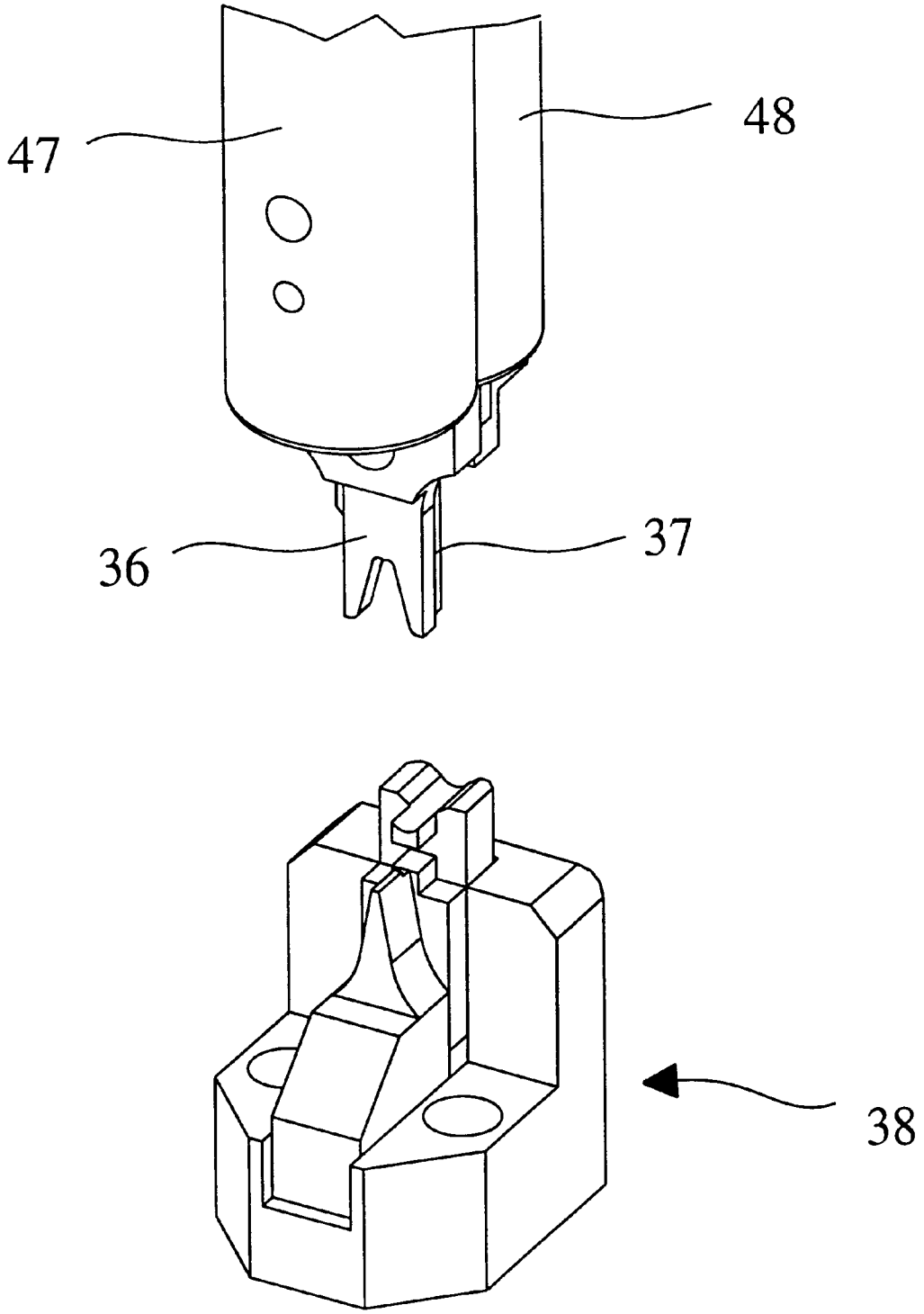
FIG. 25 is a perspective view showing the cooperation of the two insulation and conductor rams, arranged at the lower end of the ram holders of FIG. 24, with the associated anvil elements.

FIG. 25 shows, in perspective, the cooperation of the wire ram 36 and insulation ram 37, fastened to the two ram holders 47 and 48, respectively, with an associated anvil unit 38.

All the relevant drive and adjusting units of the apparatus are interconnected by way of a control unit 90 connected with a monitor 91 in such a way that, upon selection of a given contact type, automatically the corresponding contact supply station is activated, the advance of the selected contact and also of the first contact transfer unit, by a respective advancing distance associated with these, into the corresponding contact grasping position is effected, the contact grasping parts of the gripper of the second contact transfer unit are adjusted to a position corresponding to the length of the contact carrier strip portion to be grasped, and the crimping tools suitable for the selected contact are displaced into the crimping operating position, so that all the functions for fastening the selected contact to a conductor proceed fully automatically.

As mentioned before, between the crimpring press and the two ram holder 47,48 there are provided crimping pressure-measuring elements 62,62', said crimping pressure-measuring elements 62,62' being connected with a such designed control unit 90, that during the crimping process the crimping force acting via said crimping pressure-measuring elements 62,62' will be compared with preset nominal value ranges, and in the case of being out of these ranges corresponding correction signals will be produced in the control unit to effect a corresponding correction of the electric crimping height-adjustment means.

The crimping values for a number of different contact types are stored in the control unit 90 in such a way that, upon selection of a given contact type, automatically the corresponding crimping values are preset by the electric crimping height-adjustment means.

What is claimed is:

1. A crimping apparatus comprising a crimping station having a crimping press and at least one set of crimping tools, each said crimping tool including a wire ram, an insulation ram, an anvil unit and a separating unit, wherein the wire ram and the insulation ram of each crimping tool are associated with a ram holder, wherein there is associated with each of the ram holders a crimping height-adjustment means, wherein crimping pressure-measuring elements are included between said crimping press and said ram holders, said crimping pressure-measuring elements being connected to a control unit, whereby during a crimping process a crimping force as determined by said crimping pressure-measuring elements is compared with a preset nominal value range, and when said determined crimping force is outside of said range, a corresponding correction signal is produced in said control unit, thereby effecting a corresponding correction of said crimping height-adjustment means.

2. The apparatus of claim 1, wherein crimping values for a number of different contact types are stored in the control unit in such a way that, upon selection of a given contact type, the corresponding crimping values are automatically preset by the crimping height-adjustment means.

3. The apparatus of claim 1, wherein the crimping station has a plurality of crimping tools which are arranged side by side, wherein said crimping tools each have different crimping inserts, are laterally displaceable with one another, include a wire ram and an insulation ram, and include an anvil unit and a separating unit.

4. The apparatus of claim 3, wherein the crimping tools, including the anvil units associated therewith, are arranged on a laterally displaceable cross slide, wherein drive means are associated with the cross slide in order to selectively bring the crimping tool corresponding to a contact to be processed into a crimping operating position by lateral displacement of the cross slide, and wherein the two rams of each crimping insert are arranged individually on a ram holder that can be guided displaceably in a longitudinal direction on the cross slide, each ram holder is also provided with a first latching part for releasable latching to drive elements of the crimping press upon its displacement into the crimping operating position.

5. The apparatus of claim 4, further comprising latching means which cooperate with the ram holders and are arranged in such a way that the ram holders, upon their lateral displacement out of said crimping operating position by lateral displacement of the cross slide, are held in an upper starting position by said latching means, or, upon their lateral displacement into the crimping operating position, are released for their longitudinal displacement in a vertical direction.

6. The apparatus of claim 1, wherein the crimping press includes an eccentric drive which is connected to a drive motor and acts directly or indirectly on a drive slide, and wherein, to adjust a crimping height of a ram holder situated in the crimping operating position, the crimping press includes a second latching part which can be brought into releasable engagement with the first latching part of the ram holder and is arranged on the drive slide in such a way as to be adjustable in the displacement direction of the drive slide.

7. The apparatus of claim 6, wherein said second latching part is adjustable relative to the drive slide in a vertical direction by way of an eccentric motor-driven arrangement associated with the drive slide.

8. The apparatus of claim 7, wherein the eccentric motor-driven arrangement is driven by way of a stepping motor.

9. The apparatus of claim 7, wherein the eccentric motor-driven arrangement acts on the second latching part during a pressing operation by way of one of said crimping pressure-measuring elements.

* * * * *